US005762055A

United States Patent [19]

Yamashita et al.

[11] Patent Number: 5,762,055

[45] Date of Patent: Jun. 9, 1998

[54] AIR-TO-FUEL RATIO CONTROL APPARATUS FOR AN INTERNAL COMBUSTION ENGINE

[75] Inventors: Yukihiro Yamashita; Hisashi Iida, both of Kariya, Japan

[73] Assignee: Nippondenso Co., Ltd., Kariya, Japan

[21] Appl. No.: 668,143

[22] Filed: Jun. 21, 1996

[30] Foreign Application Priority Data

Jun. 27, 1995 [JP] Japan ..... 7-160226

[51] Int. Cl.[6] ..... F02D 41/04; F02D 41/14; F01N 3/20

[52] U.S. Cl. ..... 123/677; 123/688; 123/696; 60/276; 60/277; 60/284

[58] Field of Search ..... 123/478, 480, 123/488, 491, 674, 677, 688, 696; 60/274, 276, 277, 284

[56] References Cited

U.S. PATENT DOCUMENTS

| | | | |
|---|---|---|---|
| 4,501,242 | 2/1985 | Nimi et al. | 123/677 |
| 4,651,700 | 3/1987 | Kobayashi et al. | 123/677 |
| 4,656,829 | 4/1987 | Creps et al. | 60/277 |
| 4,694,803 | 9/1987 | Asakura et al. | 123/677 |
| 4,814,997 | 3/1989 | Matsumura et al. | 123/488 |
| 4,926,828 | 5/1990 | Fujimoto et al. | 123/677 |
| 5,475,975 | 12/1995 | Nasu | 60/276 |

FOREIGN PATENT DOCUMENTS

| | | | |
|---|---|---|---|
| 58-172442 | 10/1983 | Japan . | |
| 204947 | 11/1983 | Japan | 123/677 |
| 63-170537 | 7/1988 | Japan . | |
| 1-155046 | 6/1989 | Japan . | |
| 3-37344 | 2/1991 | Japan . | |
| 5-85742 | 12/1993 | Japan . | |

*Primary Examiner*—Willis R. Wolfe

*Attorney, Agent, or Firm*—Cushman Darby & Cushman IP Group of Pillsbury Madison & Sutro LLP

[57] ABSTRACT

An air-to-fuel ratio control apparatus for an internal combustion engine includes an air-to-fuel ratio sensor of a current limiting type for detecting an air-to-fuel ratio of an air-fuel mixture from a condition of exhaust gas originating from the air-fuel mixture. An air-to-fuel ratio controlling device is operative for performing feedback control in response to an output signal of the air-to-fuel ratio sensor so that the detected air-to-fuel ratio will be substantially equal to a target air-to-fuel ratio. A gain setting device is operative for setting a feedback gain of the air-to-fuel ratio feedback control in response to an atmospheric pressure.

7 Claims, 10 Drawing Sheets

AIR-TO-FUEL RATIO CONTROL APPARATUS FOR AN INTERNAL COMBUSTION ENGINE

BACKGROUND OF THE INVENTION

1. Field of the Invention

This invention relates to an air-to-fuel ratio control apparatus for an internal combustion engine which uses a feedback control technique.

2. Description of the Prior Art

It is well-known to feedback-control an air-to-fuel ratio of an air-fuel mixture in an internal combustion engine. A typical air-to-fuel ratio control apparatus uses an air-to-fuel ratio sensor exposed to exhaust gas generated in an internal combustion engine. The air-to-fuel ratio sensor detects conditions of the exhaust gas as an indication of the air-to-fuel ratio of an air-fuel mixture burning and changing into the exhaust gas.

U.S. Pat. No. 4,651,700 corresponding to Japanese published examined patent application 5-85742 discloses an internal combustion engine in which feedback control of the air-fuel ratio is carried out in accordance with the concentration of a specific composition in the exhaust gas. In U.S. Pat. No. 4,651,700, the feedback control enables the air-fuel ratio to be close to an aimed air-fuel ratio. In U.S. Pat. No. 4,651,700, the atmospheric pressure is detected, and the aimed air-fuel ratio is varied in accordance with the detected atmospheric pressure. Specifically, the aimed air-fuel ratio is changed toward a richer side the detected atmospheric pressure drops.

Japanese published unexamined patent application 63-170537 discloses an air-to-fuel ratio control apparatus for an internal combustion engine in which the air-to-fuel ratio is feedback-controlled at a target air-to-fuel ratio. In Japanese application 63-170537, the atmospheric pressure is detected, and the target air-to-fuel ratio is corrected in accordance with the detected atmospheric pressure.

Japanese published unexamined patent application 1-155046 discloses an electronically-controlled fuel injection apparatus for an internal combustion engine which implements feedback control of the air-to-fuel ratio. The feedback control in Japanese application 1-155046 is of the proportional integral type. In Japanese application 1-155046, the atmospheric pressure is detected, and a coefficient in the proportional integral control is corrected toward a greater side when the detected atmospheric pressure varies at a given rate or higher.

U.S. Pat. No. 4,501,242 corresponding to Japanese published unexamined patent application 58-172442 discloses an air-fuel ratio control apparatus for an engine which feedback controls the air-fuel ratio at the desired ratio through an integrating circuit. In U.S. Pat. No. 4,501,242, the circuit constant of the integrating circuit is increased with an increase in the altitude to improve the control response characteristic.

Japanese published unexamined patent application 3-37344 discloses an electronically-controlled fuel injection apparatus for an internal combustion engine which implements feedback control of the air-to-fuel ratio. According to Japanese application 3-37344, the engine is considered to be on a highland in the case where a variable feedback control coefficient remains equal to a limit value for a given time interval. In Japanese application 3-37344, the feedback control is corrected when the engine is considered to be on a highland.

SUMMARY OF THE INVENTION

It is an object of this invention to provide an improved air-to-fuel ratio control apparatus for an internal combustion engine.

A first aspect of this invention provides an air-to-fuel ratio control apparatus for an internal combustion engine provided with an air-to-fuel ratio sensor which detects an air-to-fuel ratio of an air-fuel mixture from a condition of exhaust gas originating from the air-fuel mixture, the air-to-fuel ratio control apparatus comprising air-to-fuel ratio controlling means for performing feedback control in response to an output signal of the air-to-fuel ratio sensor so that the detected air-to-fuel ratio will be substantially equal to a target air-to-fuel ratio; and gain setting means for setting a feedback gain of the air-to-fuel ratio feedback control in response to an atmospheric pressure.

A second aspect of this invention is based on the first aspect thereof, and provides an air-to-fuel ratio control apparatus wherein the gain setting means is operative for increasing the feedback gain as the atmospheric pressure drops.

A third aspect of this invention is based on the first aspect thereof, and provides an air-to-fuel ratio control apparatus wherein the air-to-fuel ratio controlling means comprises means for suspending the feedback control and performing prospective control in cases where given engine operating conditions continue for at least a given time interval.

A fourth aspect of this invention is based on the third aspect thereof, and provides an air-to-fuel ratio control apparatus wherein the given engine operating conditions include conditions where an integration value of a value calculated on the basis of a degree of richness of the air-fuel mixture and a flow rate of the exhaust gas is equal to at least a given value.

A fifth aspect of this invention is based on the first aspect thereof, and provides an air-to-fuel ratio control apparatus wherein the air-to-fuel ratio controlling means comprises means for, under engine operating conditions where a temperature of a catalyst for cleaning the exhaust gas becomes high, varying the target air-to-fuel ratio during the air-to-fuel feedback control in accordance with a time elapsed from a moment of start of said engine operating conditions.

A sixth aspect of this invention is based on the first aspect thereof, and provides an air-to-fuel ratio control apparatus further comprising atmospheric pressure estimating means for estimating the atmospheric pressure on the basis of a throttle opening degree and an air intake pipe pressure, the gain setting means comprising means for setting the feedback gain of the air-to-fuel ratio feedback control in response to the atmospheric pressure estimated by the atmospheric pressure estimating means.

A seventh aspect of this invention provides an air-to-fuel ratio control apparatus for an internal combustion engine which comprises an air-to-fuel ratio sensor of a current limiting type for detecting an air-to-fuel ratio of an air-fuel mixture from a condition of exhaust gas originating from the air-fuel mixture; air-to-fuel ratio feedback controlling means for performing feedback control in response to an output signal of the air-to-fuel ratio sensor so that the detected air-to-fuel ratio will be substantially equal to a target air-to-fuel ratio; prospective control means for predicting an air-to-fuel ratio of the air-fuel mixture and performing prospective control to control an actual air-to-fuel ratio in response to the predicted air-to-fuel ratio; and air-to-fuel ratio controlling means for implementing a change between the air-to-fuel ratio feedback control and the prospective control in response to operating conditions of the engine.

An eighth aspect of this invention is based on the seventh aspect thereof, and provides an air-to-fuel ratio control apparatus wherein the air-to-fuel ratio controlling means is operative for selecting the prospective control in engine operating conditions where an integration value of a value calculated on the basis of a degree of richness of the air-fuel mixture and a flow rate of the exhaust gas is equal to at least a given value.

A ninth aspect of this invention is based on the seventh aspect thereof, and provides an air-to-fuel ratio control apparatus wherein the air-to-fuel ratio feedback controlling means comprises means for, under engine operating conditions where a temperature of a catalyst for cleaning the exhaust gas becomes high, varying the target air-to-fuel ratio during the air-to-fuel feedback control in accordance with a time elapsed from a moment of start of said engine operating conditions.

A tenth aspect of this invention provides an air-to-fuel ratio control apparatus for an internal combustion engine which comprises an air-to-fuel ratio sensor of a current limiting type for detecting an air-to-fuel ratio of an air-fuel mixture from a condition of exhaust gas originating from the air-fuel mixture; air-to-fuel ratio controlling means for performing feedback control in response to an output signal of the air-to-fuel ratio sensor so that the detected air-to-fuel ratio will be substantially equal to a target air-to-fuel ratio; and signal correcting means for correcting the output signal of the air-to-fuel ratio sensor in response to an atmospheric pressure.

An eleventh aspect of this invention provides an air-to-fuel ratio control apparatus for an internal combustion engine which comprises first means for sensing an air-to-fuel ratio of an air-fuel mixture fed to the engine; second means for feedback-controlling an actual air-to-fuel ratio of the mixture in response to the air-to-fuel ratio sensed by the first means and also in response to an adjustable feedback gain; third means for sensing an atmospheric pressure applied to the engine; and fourth means for adjusting the feedback gain in response to the atmospheric pressure sensed by the third means.

A twelfth aspect of this invention provides an air-to-fuel ratio control apparatus for an internal combustion engine which comprises first means for sensing an air-to-fuel ratio of an air-fuel mixture fed to the engine; second means for sensing an atmospheric pressure applied to the engine; third means for correcting the air-to-fuel ratio sensed by the first means into a correction-resultant sensed air-to-fuel ratio in response to the atmospheric pressure sensed by the second means; and fourth means for controlling an actual air-to-fuel ratio of the mixture in response to the correction-resultant sensed air-to-fuel ratio generated by the third means.

BRIEF DESCRIPTION OF THE DRAWINGS

FIG. 6 is a flowchart of a prospective control routine of the program related to the operation of the electronic control circuit in

FIG.1.

DESCRIPTION OF THE PREFERRED EMBODIMENTS

First Embodiment

Figure 1:
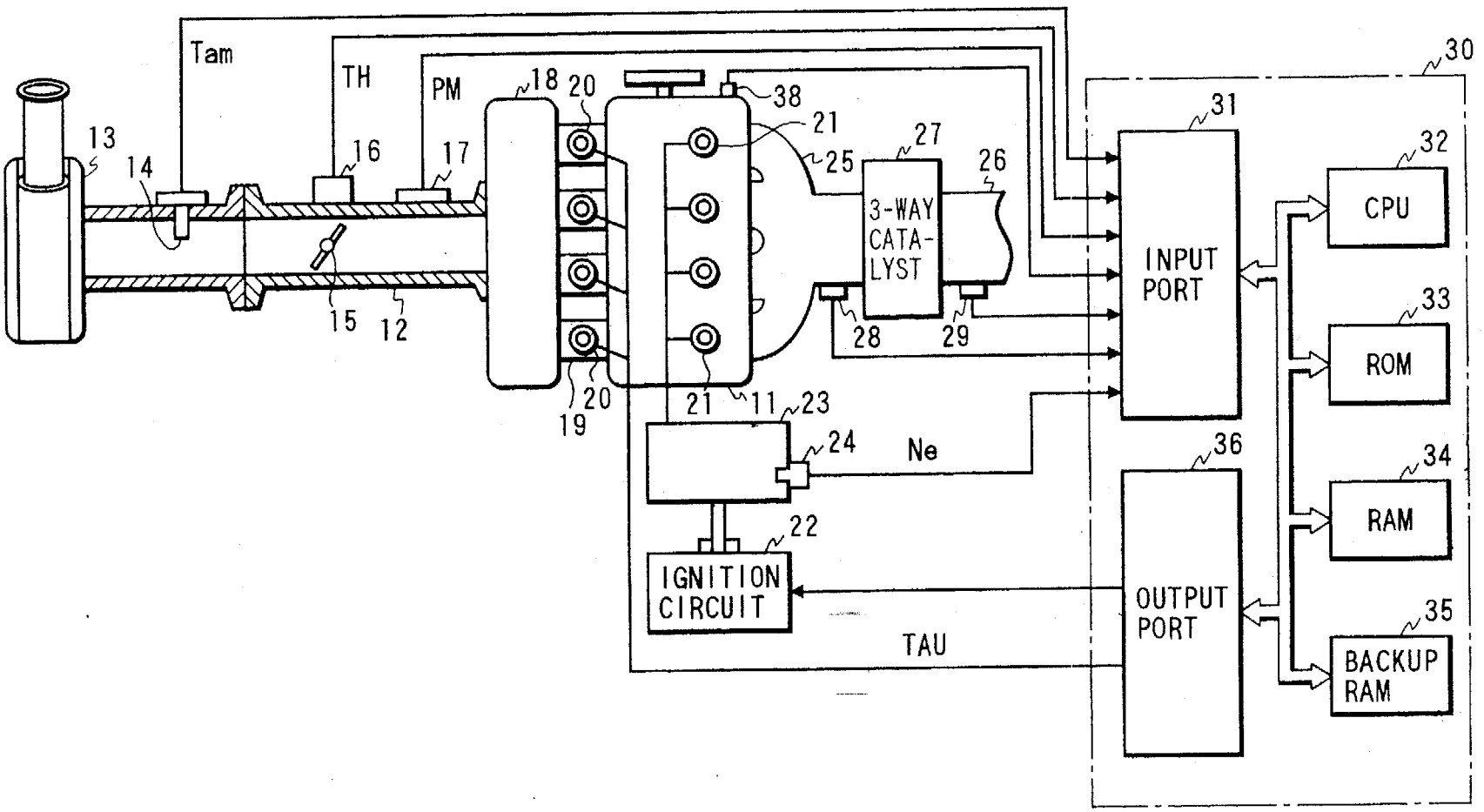
FIG. 1 is a diagram of an internal combustion engine and an engine control system including an air-to-fuel ratio control apparatus according to a first embodiment of this invention.

With reference to FIG. 1, an internal combustion engine 11 has an air intake pipe 12. An air cleaner 13 is provided at an upstream end of the air intake pipe 12. An air temperature sensor 14 disposed in a part of the air intake pipe 12 downstream of the air cleaner 13 detects the temperature Tam of air drawn into combustion chambers of the engine 11. The air temperature sensor 14 outputs a signal representing the detected air temperature Tam.

A throttle valve 15 is disposed in a part of the air intake pipe 12 downstream of the air temperature sensor 14. A throttle opening-degree sensor 16 connected to the throttle valve 15 detects the degree TH of opening through the throttle valve 15, that is, the position of the throttle valve 15. The throttle opening-degree sensor 16 outputs a signal representing the detected throttle opening degree TH.

A pressure sensor 17 disposed in a part of the air intake pipe 12 downstream of the throttle valve 15 detects the pressure PM in the air intake pipe 12 downstream of the throttle valve 15. The pressure sensor 17 outputs a signal representing the detected air intake pipe pressure PM.

A surge tank 18 is provided at a downstream end of the air intake pipe 12. Thus, the position of the surge tank 18 is downstream of the position of the pressure sensor 17. The surge tank 18 is followed by branches of an intake manifold 19 which lead to the engine combustion chambers respectively. Electrically-driven fuel injectors 20 provided on the branches of the intake manifold 19 serve to inject fuel into the branches of the intake manifold 19 respectively. The injection of fuel causes a mixture of air and fuel which is drawn into the engine combustion chambers.

Air successively passes through the air cleaner 13, the air intake pipe 12, the surge tank 18, and the branches of the intake manifold 19 before entering the engine combustion chambers.

The engine 11 is provided with spark plugs 21 extending into the engine combustion chambers respectively. High voltages generated by an ignition circuit 22 are sequentially applied to the spark plugs 21 via a distributor 23. The application of a high voltage to each of the spark plugs 21 causes a spark which ignites an air-fuel mixture in the related engine combustion chamber. The air-fuel mixture burns and changes into exhaust gas after being ignited.

A crank angle sensor 24 associated with the distributor 23 outputs twenty-four electric pulses per every two crankshaft revolutions, that is, 720° in crank angle (CA). The electric output signal of the crank angle sensor 24 represents the rotational speed of the crankshaft of the engine 11, that is, the rotational engine speed Ne. Specifically, every time interval between adjacent pulses in the output signal of the crank angle sensor 24 depends on the rotational engine speed Ne.

A coolant temperature sensor 38 connected to the engine 11 detects the temperature Thw of coolant in the engine 11. The coolant temperature sensor 38 outputs a signal representing the detected coolant temperature Thw.

The combustion chambers of the engine 11 are successively followed by exhaust ports (not shown), an exhaust manifold 25, and an exhaust pipe 26. Exhaust gas is emitted from the engine combustion chambers before successively passing through the exhaust ports (not shown), the exhaust manifold 25, and the exhaust pipe 26. A three-way catalytic converter 27 disposed in the exhaust pipe 26 changes harmful components (such as Co, HC, and NOx) of exhaust gas into harmless substances.

An air-to-fuel ratio sensor 28 is provided in a part of the exhaust manifold 25 or a part of the exhaust pipe 26 upstream of the three-way catalytic converter 27 and downstream of the place at which branches of the exhaust manifold 25 meet. The air-to-fuel ratio sensor 28 detects conditions of exhaust gas as an indication of the air-to-fuel ratio of an air-fuel mixture burning and changing into the exhaust gas. The air-to-fuel ratio sensor 28 outputs a signal depending on the air-to-fuel ratio. For example, the voltage of the output signal of the air-to-fuel ratio sensor 28 varies approximately linearly with the air-to-fuel ratio. The air-to-fuel ratio sensor 28 is of, for example, the critical current type or the current limiting type.

An air-to-fuel ratio sensor 29 is provided in a part of the exhaust pipe 26 downstream of the three-way catalytic converter 27. The air-to-fuel ratio sensor 29 detects conditions of exhaust gas as an indication of the air-to-fuel ratio of an air-fuel mixture burning and changing into the exhaust gas. The air-to-fuel ratio sensor 29 outputs a signal depending on the air-to-fuel ratio. It should be noted that the air-to-fuel ratio sensor 29 may be omitted. In addition, the air-to-fuel ratio sensor 29 may include an oxygen sensor.

An electronic control circuit 30 includes a microcomputer having a combination of an input port 31, a CPU 32, a ROM 33, a RAM 34, a backup RAM 35, and an output port 36. The electronic control circuit 30 operates in accordance with a program stored in the ROM 33.

The input port 31 of the electronic control circuit 30 receives the output signals of the air temperature sensor 14, the throttle opening-degree sensor 16, the pressure sensor 17, the crank angle sensor 24, the air-to-fuel ratio sensors 28 and 29, and the coolant temperature sensor 38. The electronic control circuit 30 derives the values of parameters of operating conditions of the engine 11 from the received sensor output signals. The electronic control circuit 30 calculates a desired fuel injection rate TAU and a desired spark timing Ig from the values of the engine operating-condition parameters. The electronic control circuit 30 generates fuel injection control signals in response to the calculated desired fuel injection rate TAU. The fuel injection control signals are applied from the output port 36 to the fuel injectors 20 respectively. The electronic control circuit 30 generates a spark control signal in response to the calculated desired spark timing Ig. The spark control signal is applied from the output port 36 to the ignition circuit 22.

The electronic control circuit 30 functions to control the air-to-fuel ratio of an air-fuel mixture in response to the output signal of the air-to-fuel ratio sensor 28. The control of the air-to-fuel ratio is designed so that the actual air-to-fuel ratio will follow a target air-to-fuel ratio, and that a difference (an error) between the actual air-to-fuel ratio and the desired air-to-fuel ratio will be reduced or nullified.

As previously described, the electronic control circuit 30 operates in accordance with a program. The program has a main routine and subroutines. One of the subroutines is designed to calculate an air-to-fuel ratio correction coefficient FAF. This sub routine is referred to as an FAF calculation routine. The FAF calculation routine is iteratively executed at fuel injection timings according to an interruption process.

Figure 2:
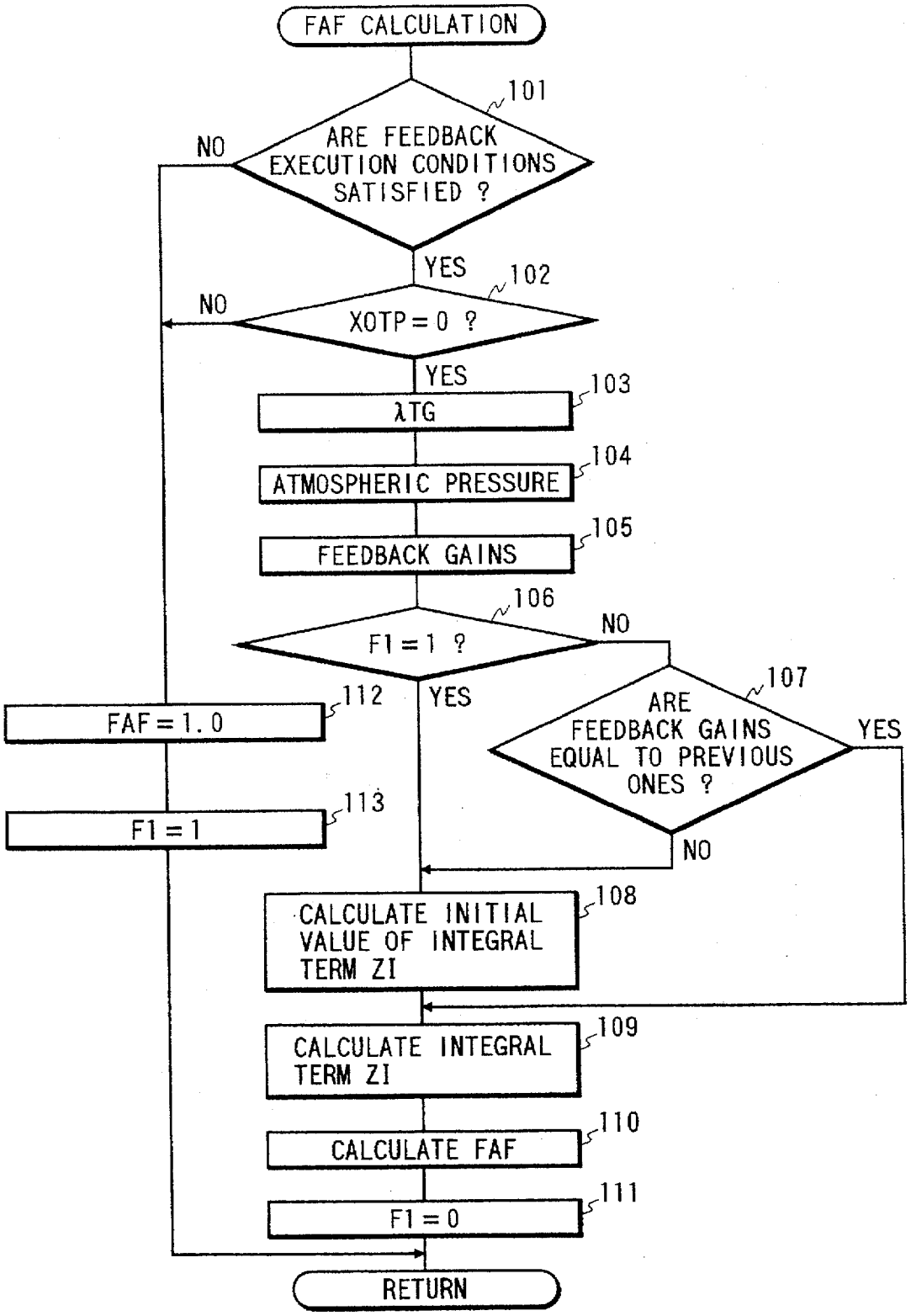
FIG. 2 is a flowchart of an FAF calculation routine of a program related to operation of an electronic control circuit in FIG. 1.

FIG. 2 is a flowchart of the FAF calculation routine. As shown in FIG. 2, a first step 101 of the FAF calculation routine decides whether or not conditions for the execution of feedback control are satisfied. An example of the conditions is that the engine coolant temperature Thw is equal to or higher than a given temperature, and that the air-to-fuel ratio sensor 28 is adequately active. When the conditions for the execution of feedback control are satisfied, the program advances from the step 101 to a step 102. Otherwise, the program advances from the step 101 to a step 112.

The step 102 decides whether or not a prospective correction flag XOTP is "0", that is, whether or not prospective correction should be unexecuted. When the prospective correction flag XOTP is "0", that is, when the prospective correction should be unexecuted, the program advances from the step 102 to a step 103. Otherwise, the program advances from the step 102 to the step 112.

The step 112 sets the air-to-fuel ratio correction coefficient FAF to "1.0". A step 113 following the step 112 sets a control mode flag F1 to "1". The control mode flag F1 being "1" means that prospective control (open loop control) should be executed. After the step 113, the current execution cycle of the FAF calculation routine ends and the program returns to the main routine.

The step 103 reads out information of a target air surplus rate λTG from the RAM 34 (see FIG. 1). The target air surplus rate λTG is equal to a target air-to-fuel ratio divided by an air-to-fuel ratio corresponding to a stoichiometric air-fuel mixture. The setting of the target air surplus rate λTG results in the setting of the target air-to-fuel ratio. As will be described later, the target air surplus rate λTG is set by another subroutine of the program.

A step 104 following the step 103 reads out information of an atmospheric pressure from the RAM 34 (see FIG. 1). As will be described later, the atmospheric pressure is calculated on the basis of the output signal of the pressure sensor 17 according to another subroutine of the program.

A step 105 subsequent to the step 104 reads out information of feedback gains K1, K2, K3, K4, and KA from the RAM 34 (see FIG. 1). As will be described later, the feedback gains K1, K2, K3, K4, and KA are set in response to the calculated atmospheric pressure according to another subroutine of the program.

A step 106 following the step 105 decides whether or not the control mode flag F1 is "1", that is, whether or not prospective control (open loop control) should be replaced by feedback control (closed loop control) at this time. When the control mode flag F1 is "1", that is, when the prospective control should be replaced by the feedback control at this time, the program advances from the step 106 to a step 108. When the control mode flag F1 is not "1", that is, when the feedback control continues, the program advances from the step 106 to a step 107.

The step 107 decides whether or not the current feedback gains are equal to the immediately-preceding feedback gains. When the current feedback gains are equal to the immediately-preceding feedback gains, the program advances from the step 107 to a step 109. Otherwise, the program advances from the step 107 to the step 108.

The step 108 calculates an initial value of an integral term ZI by referring to an equation as follows.

$$ZI=FAF(i)+K2\cdot FAF(i-1)+K3\cdot FAF(i-2)+K4\cdot FAF(i-3)-K1\cdot\lambda(i)$$

where FAF(i) denotes the current value of the air-to-fuel ratio correction coefficient FAF; FAF(i−1) denotes the immediately-preceding value of the air-to-fuel ratio correction coefficient FAF; FAF(i−2) denotes the second immediately-preceding value of the air-to-fuel ratio correction coefficient FAF; FAF(i−3) denotes the third immediately-preceding value of the air-to-fuel ratio correction coefficient FAF; K1, K2, K3, and K4 denote the feedback gains respectively; and λ(i) denotes a current air surplus rate (a current actual air surplus rate) detected via the air-to-fuel ratio sensor 28. After the step 108, the program advances to the step 109.

In this way, the initial value of the integral term ZI is calculated by the step 108 each time the prospective control is replaced by the feedback control. Also, during the execution of the feedback control, the initial value of the integral term ZI is calculated by the step 108 each time the feedback gains are changed. The calculation of the initial value of the integral term ZI by the step 108 causes the updating thereof. The updating of the initial value of the integral term ZI improves control performances such as control response characteristics upon change of the control type or change of the feedback gains. It should be noted that the feedback control (the closed loop control) corresponds to one control type while the prospective control (the open loop control) corresponds to another control type.

The step 109 updates the integral term ZI in response to the current actual air surplus rate λ(i), the target air surplus rate λTG, and the feedback gain KA by referring to an equation (a program statement) as follows.

$$ZI=ZI(i-1)+KA\cdot\{\lambda(i)-\lambda TG\}$$

where ZI(i−1) denotes the immediately-preceding value of the integral term ZI. Thus, the current value of the integral term ZI depends on the difference (the error) between the current actual air surplus rate λ(i) and the target air surplus rate λTG.

A step 110 subsequent to the step 109 calculates the current value of the air-to-fuel ratio correction coefficient FAF by referring to an equation as follows.

$$FAF(i)=ZI(i)+K1\cdot\lambda(i)+K2\cdot FAF(i-1)+K3\cdot FAF(i-2)+K4\cdot FAF(i-3)$$

where ZI(i) denotes the current integral term ZI; λ(i) denotes the current actual air surplus; FAF(i−1) denotes the immediately-preceding value of the air-to-fuel ratio correction coefficient FAF; FAF(i−2) denotes the second immediately-preceding value of the air-to-fuel ratio correction coefficient FAF; FAF(i−3) denotes the third immediately-preceding value of the air-to-fuel ratio correction coefficient FAF; and K1, K2, K3, and K4 denote the feedback gains respectively. In other words, the step 110 updates the air-to-fuel ratio correction coefficient FAF in response to the current integral term ZI, the current actual air surplus λ(i), and the feedback gains K1, K2, K3, and K4. According to the above-indicated equation used by the step 110, the current air-to-fuel ratio correction coefficient FAF(i) is set so as to reduce the difference (the error) between the actual air surplus rate λ(i) and the target air surplus rate λTG.

A step 111 subsequent to the step 110 sets the control mode flag F1 to "0". The control mode flag F1 being "0" means the execution of the feedback control. After the step 111, the current execution cycle of the program segment ends and the program returns to the main routine.

Figure 3:
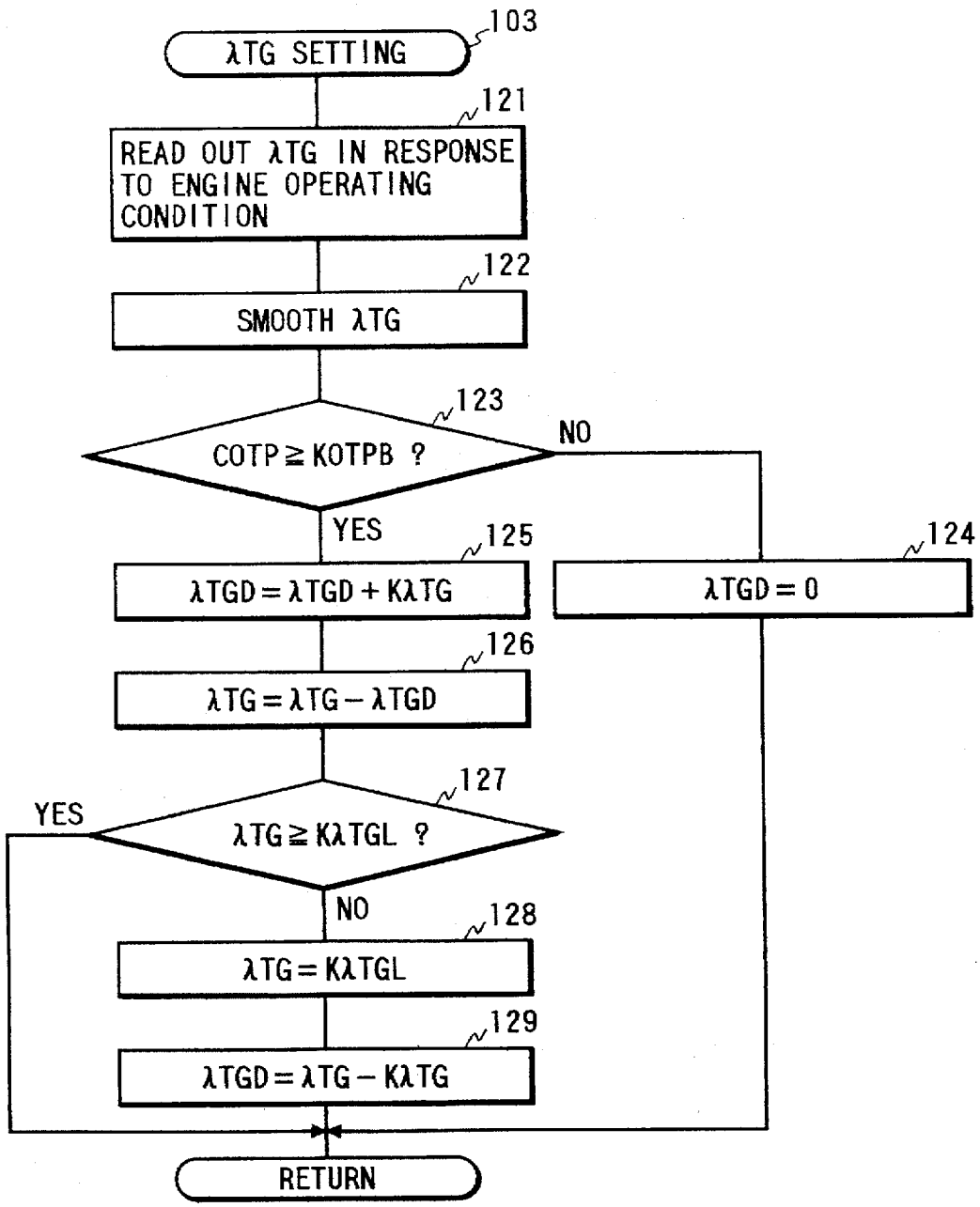
FIG. 3 is a flowchart of a λTG setting routine of the program related to the operation of the electronic control circuit in FIG. 1.

As previously described, the target air surplus rate λTG read out by the step 103 in FIG. 2 is set by a λTG setting routine of the program. FIG. 3 shows the details of the λTG setting routine. The λTG setting routine is iteratively executed according to an interruption process.

Figure 7:
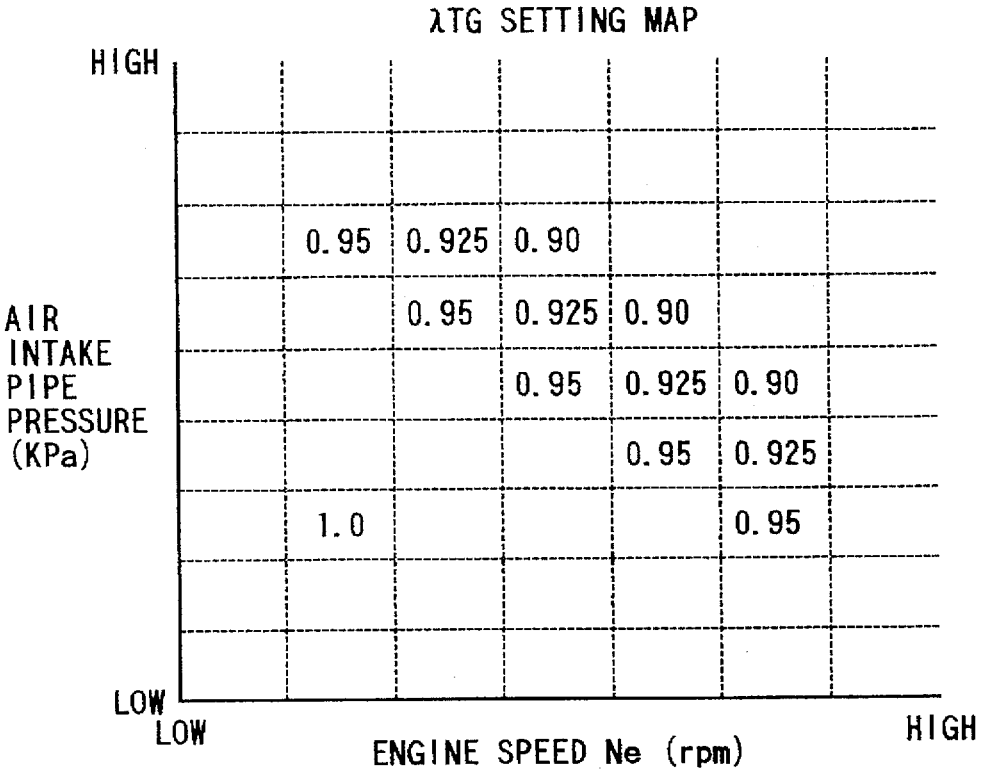
FIG. 7 is a diagram of a λTG setting map in the electronic control circuit in FIG. 1.

As shown in FIG. 3, a first step 121 in the λTG setting routine determines the target air surplus rate λTG in response to the current values of parameters of operating conditions of the engine 11. The engine operating-condition parameters include the rotational engine speed Ne and the air intake pipe pressure PM. Specifically, the step 121 uses a λTG setting map (a λTG setting table) in the determination of the target air surplus rate λTG. The λTG setting map has a structure such as shown in FIG. 7. The λTG setting map is provided in the ROM 33 (see FIG. 1). The step 121 searches the λTG setting map for the target air surplus rate λTG in response to the current values of the rotational engine speed Ne and the air intake pipe pressure PM.

A step 122 subsequent to the step 121 smooths or averages the target air surplus rate λTG in time domain according to a program statement as follows.

$$\lambda TG=\lambda TG(i-1)+1/n\cdot\lambda TG$$

where λTG denotes the current target air surplus rate; λTG(i−1) denotes the immediately-preceding target air surplus rate; and 1/n denotes a smoothing constant or an averaging constant.

A step 123 following the step 122 decides whether or not a prospective control count value COTP reaches a given value KOTPB. When the prospective control count value COTP reaches the given value KOTPB, the program advances from the step 123 to a step 125. Otherwise, the program advances from the step 123 to a step 124.

The step 124 sets a corrective quantity λTGD for the target air surplus rate λTG to "0". After the step 124, the program returns to the main routine.

The step 125 calculates the corrective quantity λTGD for the target air surplus rate λTG according to an equation (a program statement) as follows.

$$\lambda TGD=\lambda TGD(i-1)-K\lambda TGD$$

where λTGD(i−1) denotes the immediately-preceding corrective quantity for the target air surplus rate λTG, and KλTGD denotes a corrective constant corresponding to a corrective quantity. In other words, the step 125 updates or increments the corrective quantity λTGD in accordance with the corrective constant KλTGD.

A step 126 subsequent to the step 125 updates or corrects the target air surplus rate λTG in response to the corrective quantity λTGD by referring to a program statement as follows.

$$\lambda TG=\lambda TG-\lambda TGD$$

The direction of the correction by the step 126 corresponds to a direction of enriching an air-fuel mixture. The step 126 stores information of the target air surplus rate λTG into the RAM 34 (see FIG. 1) .

A step 127 following the step 126 compares the target air surplus rate λTG with a given guard value KλTGL. When the target air surplus rate λTG is equal to or greater than the given guard value KλTGL, the program exits from the step 127 and then returns to the main routine. Accordingly, in this case, the target air surplus rate λTG will be used as ;t is. When the target air surplus rate λTG is smaller than the given guard value KλTGL, the program advances from the step 127 to a step 128.

The step 128 sets the target air surplus rate λTG equal to the given guard value KλTGL. The step 128 stores information of the target air surplus rate λTG into the RAM 34 (see FIG. 1). A step 129 following the step 128 calculates the corrective quantity λTGD for the target air surplus rate λTG according to an equation as follows.

$$\lambda TGD=\lambda TG-K\lambda TGD$$

After the step 129, the program returns to the main routine.

The steps 127 and 128 subject the target air surplus rate λTG to a guard process. As a result of the guard process, the target air surplus rate λTG is prevented from falling below the given guard value KλTGL.

Regarding the λTG setting routine of FIG. 3, the target air surplus rate λTG is updated toward a richer mixture side by the step 126 each time the prospective control count value COTP reaches the given value KOTPB. In addition, the target air surplus rate λTG is held within a range equal to or higher than the given guard value KλTGL.

Figure 4:
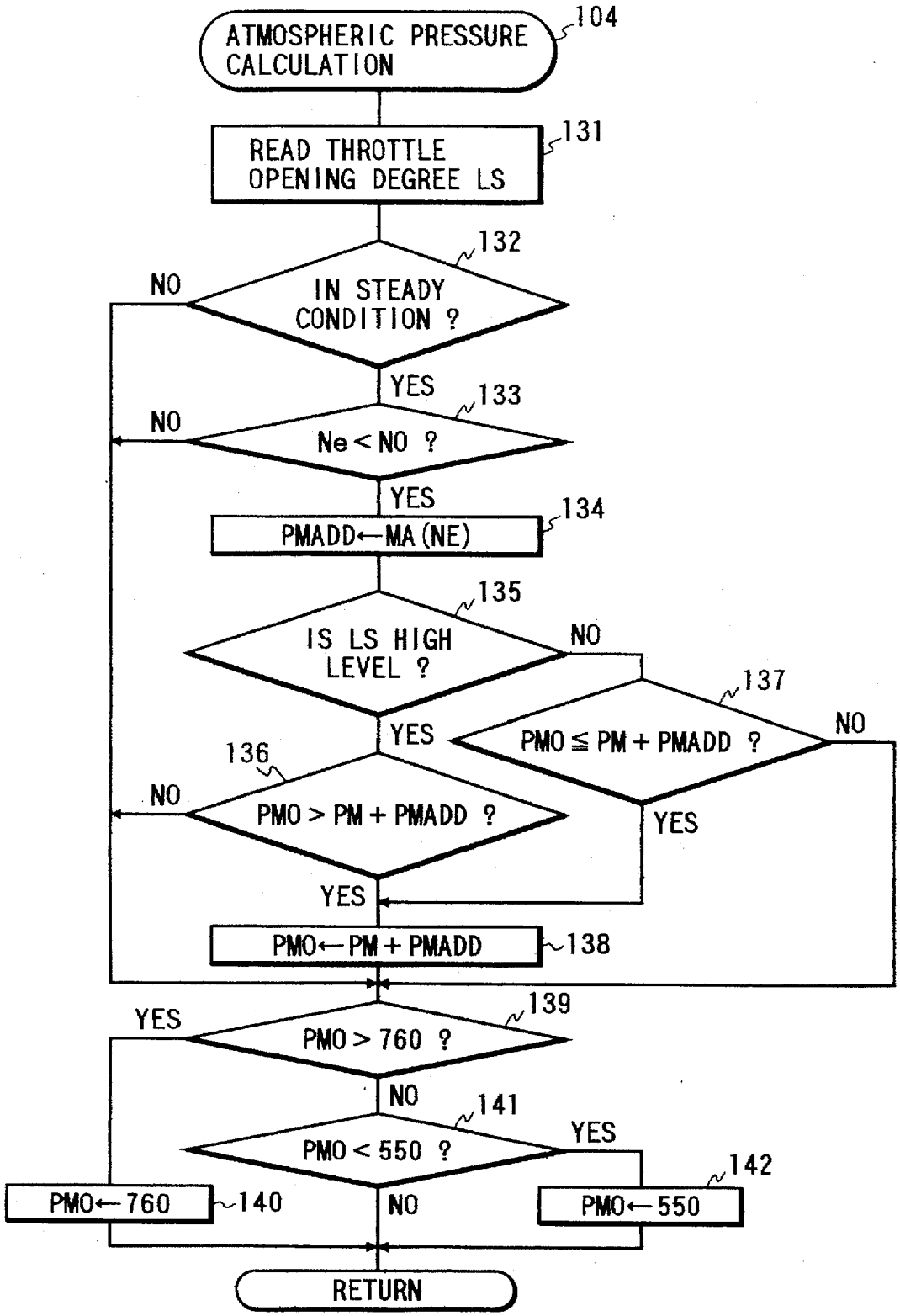
FIG. 4 is a flowchart of an atmospheric pressure calculation routine of the program related to the operation of the electronic control circuit in FIG. 1.

As previously described, the atmospheric pressure read out by the step 104 in FIG. 2 is set by an atmospheric pressure calculation routine of the program. FIG. 4 shows the details of the atmospheric pressure calculation routine. The atmospheric pressure calculation routine is iteratively executed at a given period or a period corresponding to a given crank angle. The execution of the atmospheric pressure calculation routine is started by an interruption process.

As shown in FIG. 4, a first step 131 in the atmospheric pressure calculation routine samples and holds the throttle opening degree signal LS, that is, the output signal of the throttle opening-degree sensor 16.

A step 132 following the step 131 decides whether or not operation of the engine 11 is in a steady condition. When the operation of the engine 11 is in the steady condition, the program advances from the step 132 to a step 133. Otherwise, the program jumps from the step 132 to a step 139. The decision regarding the steady condition is executed by determining whether or not the absolute value of a variation in the air intake pipe pressure PM is smaller than a given value. In this case, information of the air intake pipe pressure PM is read out from the RAM 34 (see FIG. 1).

Alternatively, the decision regarding the steady condition may be executed by determining whether or not the absolute value of "PM-PMAV" is smaller than a given value. Here, PMAV denotes a smoothed value or an average value of the air intake pipe pressure PM.

The step 133 reads out information of the current rotational engine speed Ne from the RAM 34 (see FIG. 1). The step 133 compares the current rotational engine speed Ne with a given speed NO. When the current rotational engine speed Ne is lower than the given speed NO, the program advances from the step 133 to a step 134. Otherwise, the program jumps from the step 133 to the step 139.

Figure 8:
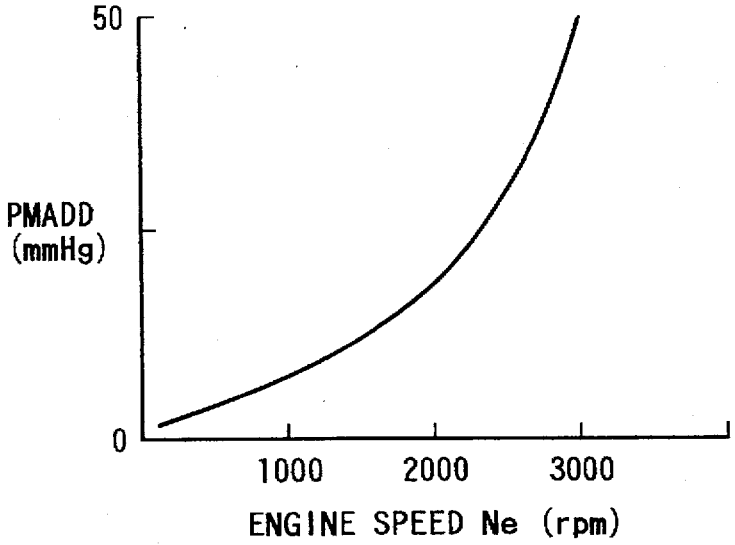
FIG. 8 is a diagram of a PMADD setting map in the electronic control circuit in FIG. 1.

The step 134 determines a corrective value PMADD for the air intake pipe pressure PM in response to the current rotational engine speed Ne by referring to a PMADD setting map shown in FIG. 8. The PMADD setting map is provided in the ROM 33 (see FIG. 1).

A step 135 following the step 134 decides whether or not the throttle opening degree signal LS is in a high-level state, that is, whether or not the throttle opening degree is greater than a given degree. When the throttle opening degree signal LS is in the high-level state, the program advances from the step 135 to a step 136. Otherwise, the program advances from the step 135 to a step 137.

The step 136 decides whether or not the calculated atmospheric pressure PMO, which has been given in the immediately-preceding execution cycle of the atmospheric pressure calculation routine, is greater than the sum of the air intake pipe pressure PM and the corrective value PMADD. When the calculated atmospheric pressure PMO is greater than the sum, the program advances from the step 136 to a step 138. Otherwise, the program jumps from the step 136 to the step 139.

The step 137 decides whether or not the calculated atmospheric pressure PMO, which has been given in the immediately-preceding execution cycle of the atmospheric pressure calculation routine, is greater than the sum of the air intake pipe pressure PM and the corrective value PMADD. When the calculated atmospheric pressure PMO is equal to or smaller than the sum, the program advances from the step 136 to the step 138. Otherwise, the program jumps from the step 136 to the step 139.

The step 138 sets the calculated atmospheric pressure PMO equal to the sum of the air intake pipe pressure PM and the corrective value PMADD. Accordingly, the step 138 updates the calculated atmospheric pressure PMO. The step 138 stores information of the calculated atmospheric pressure PMO into the RAM 34 (see FIG. 1). After the step 138, the program advances to the step 139.

The steps 135, 136, and 138 cooperate to decrease the calculated atmospheric pressure PMO as the actual atmospheric pressure acting on the engine 11 drops. Thus, in the case where the engine 11 powers a vehicle, the calculated atmospheric pressure PMO decreases when the vehicle moves from a lowland to a highland.

The steps 135, 137, and 138 cooperate to increase the calculated atmospheric pressure PMO as the actual atmospheric pressure acting on the engine 11 rises. Thus, in the case where the engine 11 powers a vehicle, the calculated atmospheric pressure PMO increases when the vehicle moves from a highland to a lowland.

The step 139 compares the calculated atmospheric pressure PMO with a pressure of 760 mmHg. When the calculated atmospheric pressure PMO is higher than a pressure of 760 mmHg, the program advances from the step 139 to a step 140. Otherwise, the program advances from the step 139 to a step 141.

The step 140 sets the calculated atmospheric pressure PMO equal to a pressure of 760 mmHg. The step 140 stores information of the calculated atmospheric pressure PMO into the RAM 34 (see FIG. 1). After the step 140, the program returns to the main routine.

The step 141 compares the calculated atmospheric pressure PMO with a pressure of 550 mmHg. When the calculated atmospheric pressure PMO is lower than a pressure of 550 mmHg, the program advances from the step 141 to a step 142. Otherwise, the program exits from the step 141 and then returns to the main routine.

The step 142 sets the calculated atmospheric pressure PMO equal to a pressure of 550 mmHg. The step 142 stores information of the calculated atmospheric pressure PMO into the RAM 34 (see FIG. 1). After the step 142, the program returns to the main routine.

The steps 139, 140, 141, and 142 subject the calculated atmospheric pressure PMO to a guard process. As a result of the guard process, the calculated atmospheric pressure PMO is prevented from moving out of the range between 550 mmHg and 760 mmHg. In general, a pressure of 550 mmHg corresponds to an altitude of 2,700 meters while a pressure of 760 mmHg corresponds to an altitude of 0 meter.

Figure 5:
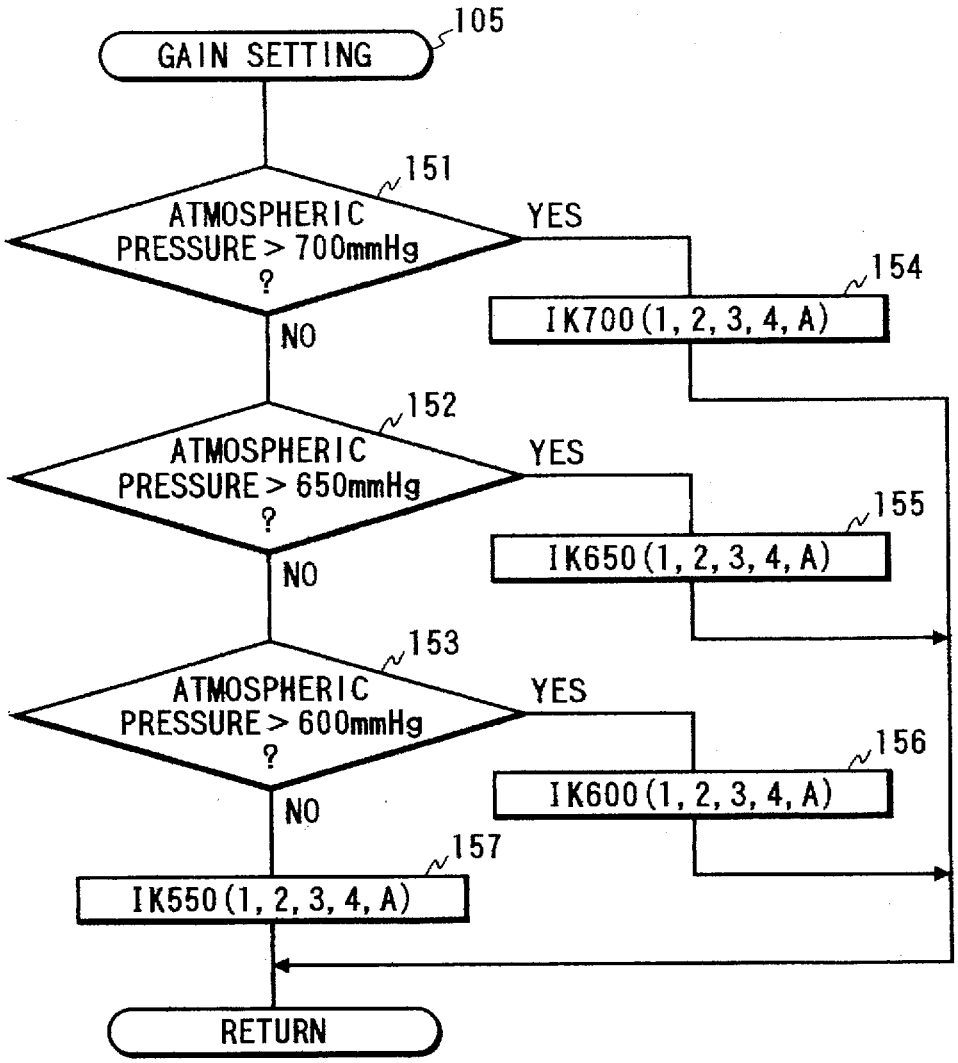
FIG. 5 is a flowchart of a feedback gain setting routine of the program related to the operation of the electronic control circuit in FIG. 1.

As previously described, the feedback gains K1, K2, K3, K4, and KA read out by the step 105 in FIG. 2 are set by a feedback gain setting routine of the program. FIG. 5 shows the details of the feedback gain setting routine. The feedback gain setting routine is iteratively executed according to an interruption process.

As shown in FIG. 5, a first step 151 in the feedback gain setting routine decides whether or not the calculated atmospheric pressure PMO given in the atmospheric pressure calculation routine is higher than a pressure of 700 mmHg. When the calculated atmospheric pressure PMO is higher than a pressure of 700 mmHg, the program advances from the step 151 to a step 154. Otherwise, the program advances from the step 151 to a step 152.

The step 154 sets feedback gains IK700 (the feedback gains K1, K2, K3, K4, and KA) by referring to a predetermined map provided in the ROM 33 (see FIG. 1). After the step 154, the program returns to the main routine.

The step 152 decides whether or not the calculated atmospheric pressure PMO is higher than a pressure of 650 mmHg. When the calculated atmospheric pressure PMO is higher than a pressure of 650 mmHg, the program advances from the step 152 to a step 155. Otherwise, the program advances from the step 152 to a step 153.

The step 155 sets feedback gains IK650 (the feedback gains K1, K2, K3, K4, and KA) by referring to a predetermined map provided in the ROM 33 (see FIG. 1). After the step 155, the program returns to the main routine.

The step 153 decides whether or not the calculated atmospheric pressure PMO is higher than a pressure of 600 mmHg. When the calculated atmospheric pressure PMO is higher than a pressure of 600 mmHg, the program advances from the step 153 to a step 156. Otherwise, the program advances from the step 153 to a step 157.

The step 156 sets feedback gains IK600 (the feedback gains K1, K2, K3, K4, and KA) by referring to a predetermined map provided in the ROM 33 (see FIG. 1). After the step 156, the program returns to the main routine.

The step 157 sets feedback gains IK550 (the feedback gains K1, K2, K3, K4, and KA) by referring to a predetermined map provided in the ROM 33 (see FIG. 1). After the step 157, the program returns to the main routine.

The feedback gains K1, K2, K3, K4, and KA set by the steps 154, 155, 156, and 157 are designed to increase as the calculated atmospheric pressure drops.

Figure 6:
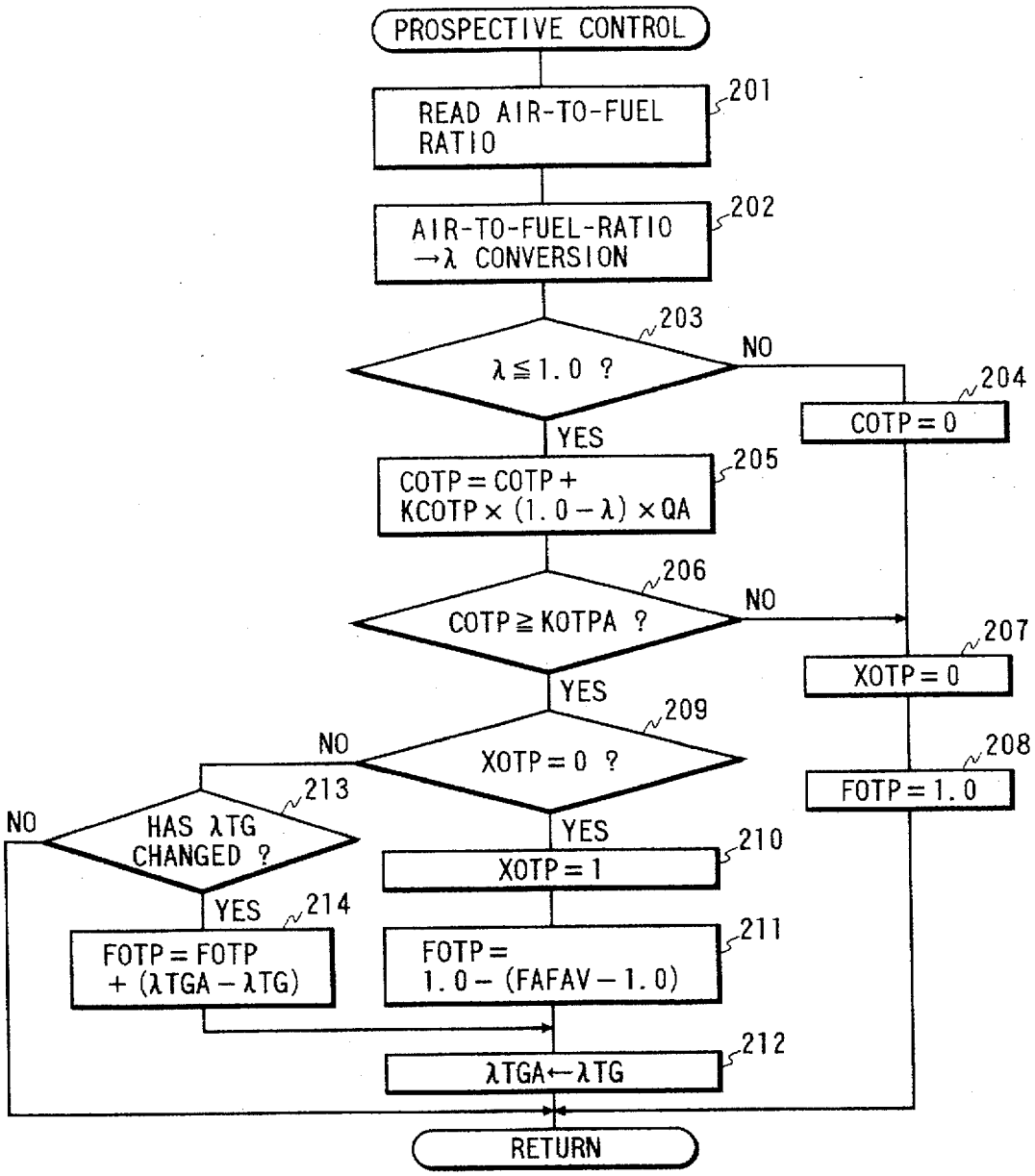

One of the sub routines of the program is a prospective control routine. FIG. 6 shows the details of the prospective control routine. As shown in FIG. 6, a first step 201 in the prospective control routine derives the current air-to-fuel ratio from the output signal of the air-to-fuel ratio sensor 28.

A step 202 following the step 201 calculates an actual air surplus rate "λ" from the current air-to-fuel ratio. Specifically, the actual air surplus rate "λ" is equal to the current air-to-fuel ratio divided by an air-to-fuel ratio corresponding to a stoichiometric air-fuel mixture.

A step 203 subsequent to the step 202 compares the actual air surplus rate "λ" with a value of 1.0 to decide whether a related air-fuel mixture is rich or lean. When the actual air surplus rate "λ" is greater than a value of 1.0, that is, when the related air-fuel mixture is lean, the program advances from the step 203 to a step 204. When the actual air surplus rate "λ" is equal to or smaller than a value of 1.0, that is, when the related air-fuel mixture is rich, the program advances from the step 203 to a step 205.

The step 204 clears the prospective control count value COTP to "0". After the step 204, the program advances to a step 207.

The step 205 increments the prospective control count value COTP according to a program statement as follows.

$$COTP=COTP+KCOTP\times(1.0-\lambda)\times\lambda QA$$

where KCOTP denotes a constant; (1.0−λ) denotes the degree of richness; and QA denotes the air flow rate (that is, the rate of air flow into the engine 11 or the rate of exhaust gas flow from the engine). Accordingly, the increment of the prospective control count value COTP increases as the degree of richness increases. In addition, the increment of the prospective control count value COTP increases as the air flow rate QA increases.

A step 206 following the step 205 compares the prospective control count value COTP with a given value KOTPA. When the prospective control count value COTP is smaller than the given value KOTPA, the program advances from the step 206 to a step 207. When the prospective control count value COTP is equal to or greater than the given value KOTPA, the program advances from the step 206 to a step 209.

The step 207 sets the prospective correction flag XOTP to "0". The prospective correction flag XOTP being "0" indicates that the prospective correction should not be executed.

A step 208 following the step 207 sets a prospective correction coefficient FOTP to "1.0". After the step 208, the program returns to the main routine.

The step 209 decides whether or not the prospective correction flag XOTP is "0", that is, whether or not the prospective correction has been absent from the immediately-preceding control execution cycle. When the prospective correction flag XOTP is "0", the program advances from the step 209 to a step 210. Otherwise, the program advances from the step 209 to a step 213.

The step 210 sets the prospective correction flag XOTP to "1". The prospective correction flag XOTP being "1" indicates that the prospective correction should be executed. Thus, in the case where conditions of $\lambda \leqq 1.0$ or air-fuel mixture rich conditions continue until the prospective control count value COTP reaches the given value KOTPA, the prospective correction flag XOTP is set to "1" so that the air-to-fuel ratio control mode is changed to the prospective control.

A step 211 subsequent to the step 210 calculates an initial value of the prospective correction coefficient FOTP according to an equation as follows.

$$FOTP=1.0-(FAFAV-1.0)$$

where FAFAV denotes a mean value or an average value of the air-to-fuel ratio correction coefficient FAF which occurs during a given time interval. After the step 211, the program advances to a step 212.

The step 213 decides whether or not the target air surplus rate λTG has just changed. When the target air surplus rate λTG has just changed, the program advances from the step 213 to a step 214. Otherwise, the program exits from the step 213 and then returns to the main routine.

The step 214 updates the prospective correction coefficient FOTP according to a program statement as follows.

$$FOTP=FOTP+(\lambda TGA-\lambda TG)$$

where λTGA denotes the immediately-preceding target air surplus rate, and λTG denotes the current target air surplus rate. After the step 214, the program advances to the step 212.

The step 212 sets the value λTGA equal to the target air surplus rate λTG. The step 212 stores information of the value λTGA into the RAM 34 (see FIG. 1). After the step 212, the program returns to the main routine.

Figure 9:
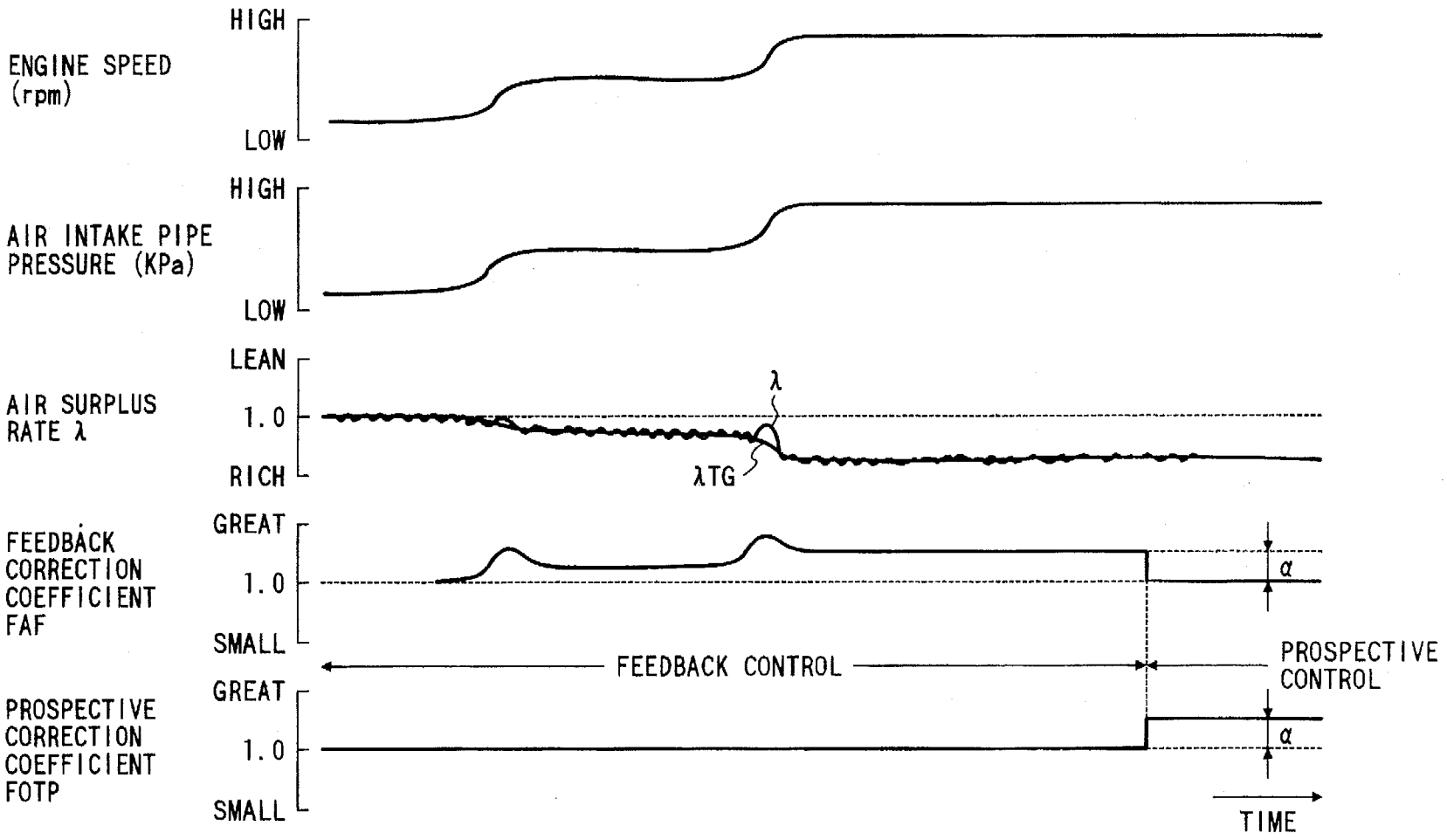
FIG. 9 is a time-domain diagram of various conditions which occur when feedback control is replaced by prospective control in the first embodiment of this invention.
Figure 10:
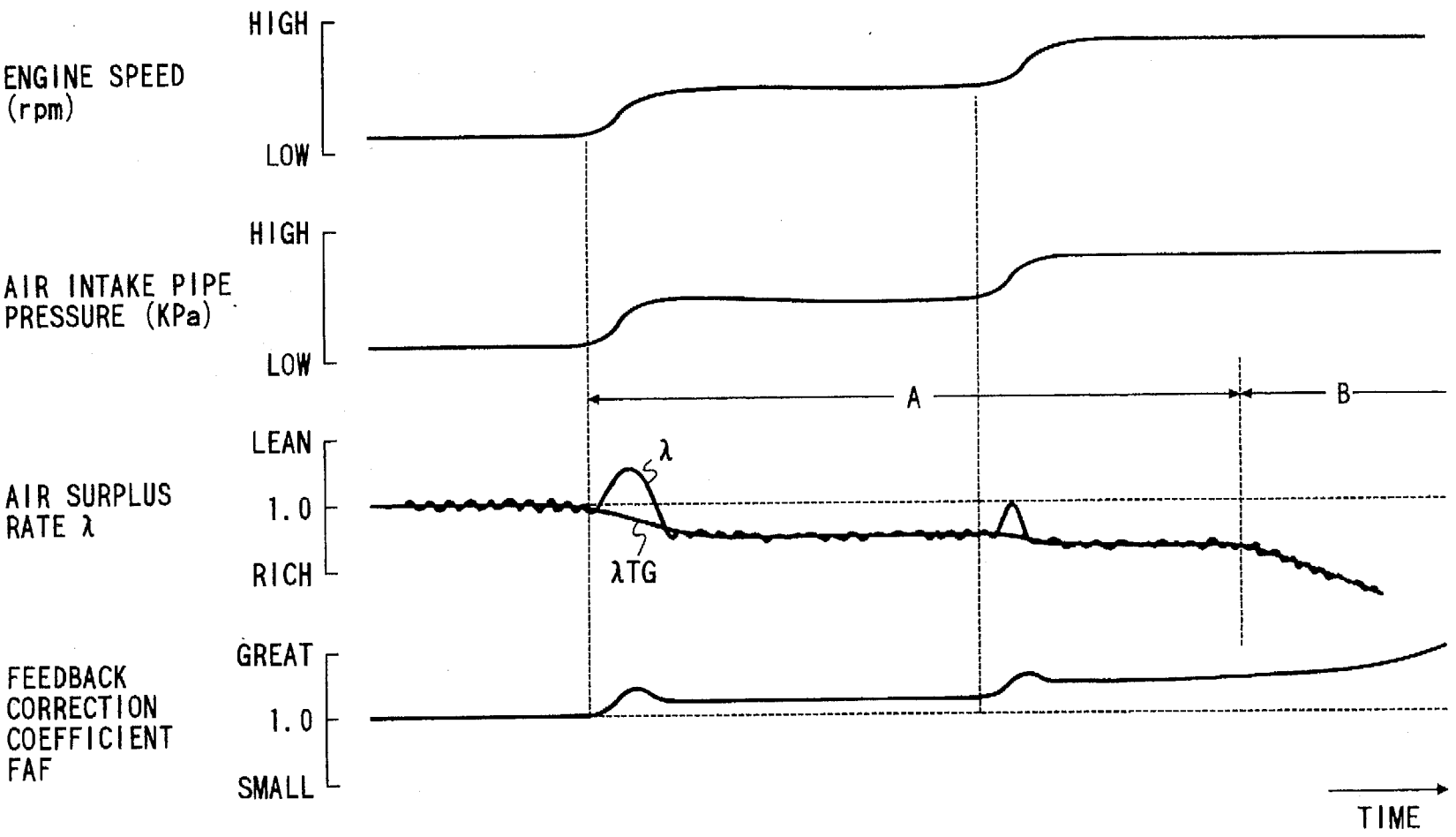
FIG. 10 is a time-domain diagram of various conditions which occur when the engine is operated at a heavy load and is supplied with a rich air-fuel mixture in the first embodiment of this invention.

With reference to FIGS. 9 and 10, the target air surplus rate λTG is corrected toward a richer mixture side as the rotational engine speed Ne or the air intake pipe pressure PM increases. It should be noted that the rotational engine speed Ne and the air intake pipe pressure PM determine a load on the engine 11. The air-to-fuel ratio correction coefficient FAF increases as the target air surplus rate λTG is corrected toward a richer mixture side. As shown in FIG. 9, during the execution of the feedback control, the prospective correction coefficient FOTP is held at "1.0". When the feedback control is replaced by the prospective control (the open loop control), the initial value of the prospective correction coefficient FOTP is calculated by the step 211 in FIG. 6. During the execution of the prospective control, the prospective correction coefficient FOTP is updated by the step 214 in FIG. 6 each time the target air surplus rate λTG changes.

Figure 11:
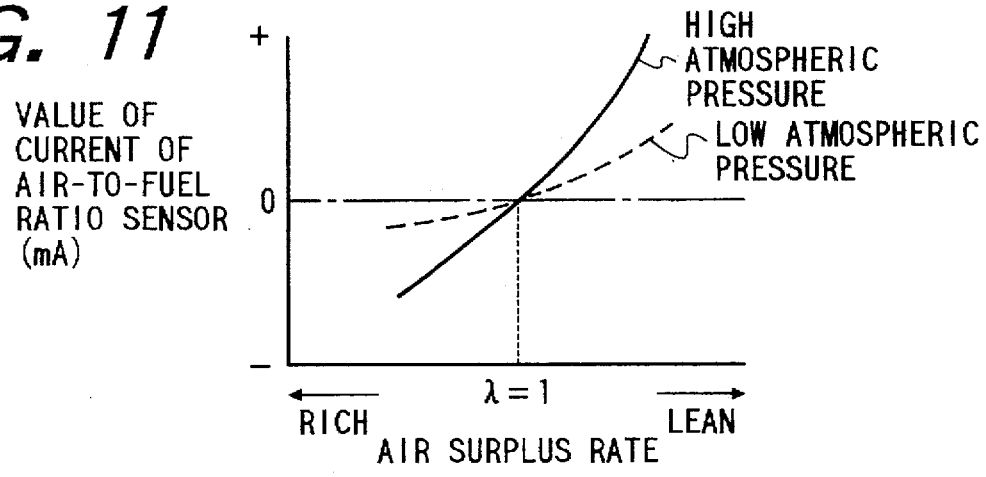
FIG. 11 is a diagram of the relation among an output current of an air-to-fuel ratio sensor, an air surplus rate, and an atmospheric pressure.

As shown in FIG. 11, the value of an output current of the air-to-fuel ratio sensor 28 depends on the atmospheric pressure. As previously described, the air intake pipe pressure PM is detected by the pressure sensor 17, and the atmospheric pressure is calculated from the air intake pipe pressure PM. Furthermore, the feedback gains K1, K2, K3, K4, and KA of the air-to-fuel ratio control are adjusted in accordance with the calculated atmospheric pressure. Accordingly, in the case where the air-to-fuel ratio related to the engine 11 is feedback-controlled at around the stoichiometric value, it is possible to improve the feedback control characteristics which occur upon a change of the atmospheric pressure. The improvement of the feedback control characteristics enables a reduction of harmful emission from the engine 11. When the engine 11 powers a vehicle, the improvement of the feedback control characteristics enables an enhancement of the drivability of the vehicle.

While the atmospheric pressure is calculated from the output signal of the pressure sensor 17 in this embodiment, an atmospheric pressure sensor may be provided to directly generate information of the atmospheric pressure.

Generally, the air-to-fuel ratio represented by the output signal of an air-to-fuel ratio sensor of a certain type tends to deviate from the actual air-to-fuel ratio in a leaner side in the case where the air-to-fuel ratio sensor has been exposed to exhaust gas originating from a rich air-fuel mixture for a long time. The cause of this phenomenon is that the oxygen concentration in the sensing part of the air-to-fuel ratio sensor drops excessively, and hence the sensing part falls into oxygen poverty. The deviation of the detected air-to-fuel ratio from the actual air-to-fuel ratio in the leaner side causes feedback control to further enrich an air-fuel mixture. Thus, in this case, the air-fuel mixture tends to be further controlled toward a richer side, and the feedback control is liable to fall into a vicious cycle.

According to this embodiment, in the case where conditions of $\lambda \leqq 1.0$ or air-fuel mixture rich conditions continue until the prospective control count value COTP reaches the given value KOTPA, the air-to-fuel ratio control mode is changed from the feedback control (the closed loop control) to the prospective control (the open loop control). Thus, in this case, even when the sensing part of the air-to-fuel ratio sensor 28 falls into oxygen poverty, the actual air-to-fuel ratio can be suitably controlled since the prospective control is independent of the output signal of the air-to-fuel ratio sensor 28.

With reference to FIG. 10, in a heavy-load engine operation range "A", the target air surplus rate "λ" (the target air-to-fuel ratio) is changed step by step toward a richer mixture side so as to prevent an excessive increase in harmful emissions from the engine 11 and also an excessive reduction in fuel economy. In a heavier-load engine operation range "B", the target air surplus rate "λ" (the target air-to-fuel ratio) is gradually changed toward a richer mixture side so as to prevent an excessive increase in the temperature of the catalytic converter 27. It should be noted that the feed of a rich air-fuel mixture to the engine 11 prevents an excessive increase in the temperature of the catalytic converter 27 which might damage the catalytic converter 27.

Second Embodiment

A second embodiment of this invention is similar to the first embodiment thereof except for design changes indicated hereinafter.

Figure 12:
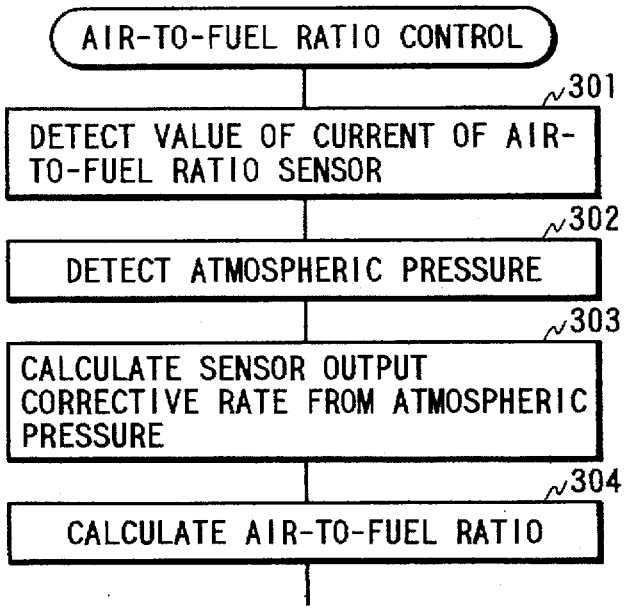
FIG. 12 is a flowchart of an air-to-fuel ratio control routine of a program in a second embodiment of this invention.

FIG. 12 shows a part of an air-to-fuel ratio control routine of a program related to operation of an electronic control circuit 30 (see FIG. 1) in the second embodiment of this invention. As shown in FIG. 12, a first step 301 of the air-to-fuel ratio control routine detects an output current of an air-to-fuel ratio sensor 28 (see FIG. 1).

A step 302 following the step 301 detects an atmospheric pressure. Specifically, the step 302 calculates the atmospheric pressure from an air intake pipe pressure PM detected by a pressure sensor 17 (see FIG. 1) as in the first embodiment of this invention. Alternatively, the step 302 may detect the atmospheric pressure from the output signal of an additionally-provided atmospheric pressure sensor.

Figure 13:
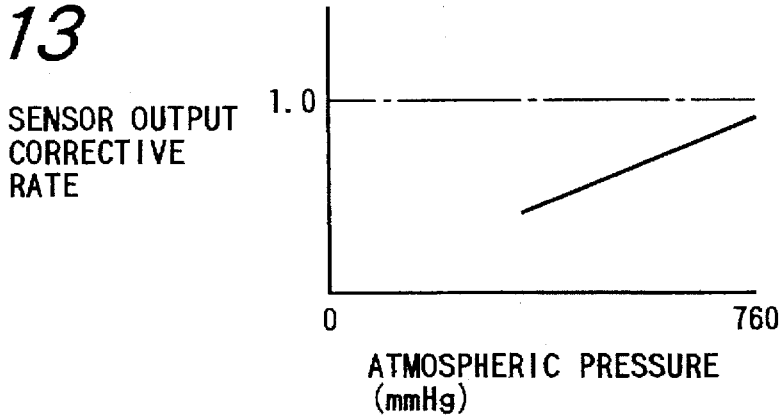
FIG. 13 is a diagram of a corrective rate setting map in the second embodiment of this invention.

A step 303 subsequent to the step 302 determines a corrective rate for the sensor output current in response to the detected atmospheric pressure by referring to a corrective rate setting map shown in FIG. 13. The corrective rate setting map is provided in a ROM 33 (see FIG. 1).

A step 304 following the step 303 multiplies the detected output current of the air-to-fuel ratio sensor 28 by the determined corrective rate for the sensor output current. The step 304 calculates an air-to-fuel ratio (an air surplus rate) from the result of the multiplication. The calculated air-to-fuel ratio will be used as a detected air-to-fuel ratio in later steps.

Steps following the step 304 control an actual air-to-fuel ratio in response to the detected air-to-fuel ratio in a known way or in a way similar to that in the first embodiment of this invention.

What is claimed is:

1. An air-to-fuel ratio control apparatus for an internal combustion engine provided with an air-to-fuel ratio sensor which detects an air-to-fuel ratio of an air-to-fuel mixture from a condition of an exhaust gas originating from the air-fuel mixture, the air-fuel ratio control apparatus comprising:

air-to-fuel ratio controlling means for performing feedback control in response to an output signal of the air-to-fuel ratio sensor so that the detected air-to-fuel ratio will be substantially egual to a target air-to-fuel ratio; and gain setting means for setting a feedback gain of the feedback control performed by the air-to-fuel ratio controlling means in response to an atmospheric pressure, wherein the air-to-fuel ratio controlling means comprises:

means for suspending the feedback control and performing prospective control in cases where given engine operating conditions continue for at least a given time interval.

2. An air-to-fuel ratio control apparatus as recited in claim 1, wherein the given engine operating conditions include conditions in which an integration value of a value calculated based on a degree of richness of the air-fuel mixture and a flow rate of the exhaust gas is equal to at least a given value.

3. An air-to-fuel ratio control apparatus for an internal combustion engine provided with an air-to-fuel ratio sensor which detects an air-to-fuel ratio of an air-to-fuel mixture from a condition of an exhaust gas originating from the air-fuel mixture, the air-fuel ratio control apparatus comprising:

air-to-fuel ratio controlling means for performing feedback control in response to an output signal of the air-to-fuel ratio sensor so that the detected air-to-fuel ratio will be substantially egual to a target air-to-fuel ratio; and gain setting means for setting a feedback gain of the feedback control performed by the air-to-fuel ratio controlling means in response to an atmospheric pressure, wherein the air-to-fuel ratio controlling means comprises:

means for, under engine operating conditions in which a temperature of a catalyst for cleaning the exhaust gas becomes high, varying the target air-to-fuel ratio during the feedback control by the air-to-fuel ratio controlling means in accordance with a time elapsed from a starting moment of the engine operating conditions.

4. An air-to-fuel ratio controlling apparatus for an internal combustion engine, comprising:

an air-to-fuel ratio sensor for detecting an air-to-fuel ratio of an air-fuel mixture from a condition of an exhaust gas originating from the air-fuel mixture;

air-to-fuel ratio feedback controlling means for performing feedback control in response to an output signal of the air-to-fuel ratio sensor so that the detected air-to-fuel ratio will be substantially equal to a target air-to-fuel ratio;

prospective control means for predicting an air-to-fuel ratio of the air-fuel mixture and performing prospective control to control an actual air-to-fuel ratio in response to the predicted air-to-fuel ratio; and air-to-fuel ratio controlling means for deciding whether the output signal of the air-to-fuel ratio sensor is outside a predetermined range, and implementing a change from the feedback control to the prospective control when the air-to-fuel ratio controlling means decides that the output signal of the air-to-fuel ratio sensor is outside the predetermined range.

5. An air-to-fuel ratio control apparatus for an internal combustion engine, comprising:

an air-to-fuel ratio sensor for detecting an air-to-fuel ratio of an air-fuel mixture from a condition of an exhaust gas originating from the air-fuel mixture;

air-to-fuel ratio feedback controlling means for performing feedback control in response to an output signal of the air-to-fuel ratio sensor so that the detected air-to-fuel ratio will be substantially egual to a target air-to-fuel ratio;

prospective control means for predicting an air-to-fuel ratio of the air-fuel mixture and performing prospective control to control an actual air-to-fuel ratio in response to the predicted air-to-fuel ratio; and air-to-fuel ratio controlling means for implementing a change between the feedback control and the prospective control in response to operating conditions of the engine, wherein the air-to-fuel ratio controlling means is operative for selecting the prospective control during the operating conditions of the engine in which an integration value of a value calculated based on a degree of richness of the air-fuel mixture and a flow rate of the exhaust gas is equal to at least a given value.

6. An air-to-fuel ratio controlling apparatus for an internal combustion engine, comprising:

an air-to-fuel ratio sensor for detecting an air-to-fuel ratio of an air-fuel mixture from a condition of an exhaust gas originating from the air-fuel mixture;

air-to-fuel ratio feedback controlling means for performing feedback control in response to an output signal of the air-to-fuel ratio sensor so that the detected air-to-fuel ratio will be substantially egual to a target air-to-fuel ratio;

prospective control means for predicting an air-to-fuel ratio of the air-fuel mixture and performing prospective control to control an actual air-to-fuel ratio in response to the predicted air-to-fuel ratio; and air-to-fuel ratio controlling means for implementing a change between the feedback control and the prospective control in response to operating conditions of the engine, wherein the air-to-fuel ratio feedback controlling means comprises means for, under engine operating conditions in which a temperature of a catalyst for cleaning the exhaust gas becomes high, varying the target air-to-fuel ratio during the feedback control by the air-to fuel ratio feedback controlling means in accordance with a time elapsed from a starting moment of the engine operating conditions.

7. An air-to-fuel ratio controlling apparatus for an internal combustion engine, comprising:

an air-to-fuel ratio sensor for detecting an air-to-fuel ratio of an air-fuel mixture from a condition of an exhaust gas originating from the air-fuel mixture;

air-to-fuel ratio feedback controlling means for performing feedback control in response to an output signal of the air-to-fuel ratio sensor so that the detected air-to-fuel ratio will be substantially equal to a target air-to-fuel ratio;

prospective control means for predicting an air-to-fuel ratio of the air-fuel mixture and performing prospective control to control an actual air-to-fuel ratio in response to the predicted air-to-fuel ratio; and air-to-fuel ratio controlling means for deciding whether the output signal of the air-to-fuel ratio sensor remains outside a predetermined range during at least a given time interval, and for implementing a change from the feedback control to the prospective control when the air-to-fuel-ratio controlling means decides that the output signal of the air-to-fuel ratio sensor remains outside the predetermined range during the at least given time interval.

* * * * *